US005115846A

United States Patent [19]

Miller et al.

[11] Patent Number: 5,115,846

[45] Date of Patent: May 26, 1992

[54] RAPID-ACTION, ANTI-JOLT EDGER CHARGER SYSTEM

[75] Inventors: Donald F. Miller, Prince George; John R. Chapman, Langley, both of Canada

[73] Assignee: Optimil Machinery, Inc., Delta, Canada

[21] Appl. No.: 660,677

[22] Filed: Feb. 25, 1991

[51] Int. Cl.[5] ..... B27B 1/00; B27B 25/02

[52] U.S. Cl. ..... 144/246 R; 83/365; 83/367; 83/422; 83/436; 144/242 R; 144/242 E; 144/249 R; 144/356; 144/2 R; 198/457; 198/624

[58] Field of Search ..... 144/2 R, 3 R, 242 R, 144/242 C, 242 E, 245 R, 246 R, 246 D, 249 A, 356, 357, 246 F; 83/364, 365, 367, 422, 436; 198/457, 624, 627

[56] References Cited

U.S. PATENT DOCUMENTS

| | | | |
|---|---|---|---|
| 3,742,992 | 7/1973 | McMillan | 144/246 R |
| 3,827,324 | 8/1974 | Allen | 144/246 R |
| 4,462,443 | 7/1984 | Allen | 144/242 E |
| 4,700,758 | 10/1987 | Bernath | 144/242 E |
| 4,823,851 | 4/1989 | Seffens | 144/242 E |

*Primary Examiner*—W. Donald Bray
*Attorney, Agent, or Firm*—Kolisch, Hartwell, Dickinson, McCormack & Heuser

[57] ABSTRACT

A lumber workpiece charger system for an edger wherein transfer of a workpiece occurs under rapid non-jolting control for pieces positioning, with the workpiece, throughout its delivery, clamped in proper orientation for hand-off to the edger.

2 Claims, 3 Drawing Sheets

RAPID-ACTION, ANTI-JOLT EDGER CHARGER SYSTEM

BACKGROUND AND SUMMARY OF THE INVENTION

This invention pertains generally to what is known in the wood products industry as the secondary breakdown of logs or lumber, and more specifically, to a lumber workpiece charger system that offers significantly improved feeding and handling of workpieces to an edger.

In the wood products field, market conditions in recent years have riveted attention on the need for increasingly precise processing control to maximize yield and to minimize waste. In addition, the same market conditions have focused concern on increasing the speed with which usable output can occur.

One area in which precision processing advances have certainly been seen in recent years is in the area of so-called edging of flitches, cants or boards preparatory to the making, for example, of dimensioned lumber. The edging process generally falls within what is referred to above as secondary breakdown activity.

In the past, there has been a somewhat unhappy mutual exclusivity between speed of handling in the edging process and precision in maximizing yield. For example, it is typical that, say, a board which is to be edged is transported laterally (normal to its longitudinal axis) beneath a scanning system which takes a look at the board's outline, taking into account wane where such exists, with scanning data then produced and used, as by a computer system, to determine how the edges of this board should be trimmed for maximum ultimate yield. A trimming decision might, for example, involve taking more wood off one long edge than off the other of the board, might require that the board be slightly angulated before feeding through an edger, as well as other things.

The so-called trimming decision regarding edging is realized in a variety of conventional pre-positioning or cuing devices, such as adjustable pins which rise into the travel path of a board to define what might be thought of as the proper "leading edge" orientation that should be used in shifting the board into the feed-intake station in an edger.

Maintenance of proper position, from this point forward, requires careful positive handling of the board as the same as transported from its pre-positioned and angularly cued condition into the intake station of an edger, all to assure that when the board is "taken" by the edger, it will be guided along the edger's working axis with the proper predetermined angular and lateral orientation. However, equipment available in the past capable of accomplishing appropriate precision handling is relatively slow in operation. For example, prior art equipment is typically capable of handling successive work pieces at a rate approximating about 25- to about 30-pieces-per-minute under circumstances producing relatively gentle, non-damaging handling.

Equipment offering high-speed transfer of a board from a pre-positioned cued condition to a handed-off condition to an edger typically has involved fairly violent jolting action which often offsets precision through failure to maintain,proper board orientation.

A general object of the present invention is to provide an improved edger charger system which offers the best of both worlds and the worst of neither. More specifically, an edger charger system is proposed herein which is capable of high-speed, anti-jolting, highly-precise handling of a board, or like workpiece, as the same is moved from a pre-positioned laterally and angularly cued condition toward ultimate hand-off for processing by an edger.

According to a preferred embodiment of the invention, the proposed charger system includes a precharge station which is laterally offset from the intake station of an associated charger, which precharge station is adapted for receiving and holding, in succession, workpieces which are, based upon prescanning data, laterally and angularly cued for proper transport through the edger. The system further includes a positive-action pinch-roll mechanism which facially grips opposite faces of a workpiece held in the precharge station. This pinch-roll mechanism, moved under the influence of a computer-controlled, hydraulic, linear positioner, shuttles a gripped workpiece rapidly (i.e., with rapid acceleration, high speed, and rapid deceleration) to the intake station in the charger. This movement is accomplished without jolting, and as a consequence with little likelihood for disorientation of the properly pre-cued board.

While the pinch-roll mechanism of the charger system continues to grip the board in the intake station, the usual clamp-roll mechanism in the edger closes upon the board, gripping the same, thus receiving a hand-off of the board before release of the latter by the charger's pinch-roll mechanism.

Again under the influence of the linear positioner, the pinch-roll mechanism is return-shuttled to the precharge station for similar handling of the next successive workpiece.

Positive-action gripping of a workpiece from a precued condition through gripped hand-off to an edger strongly promotes precision handling performance. Transfer motion produced under the influence of a computer-controlled hydraulic linear positioner enables rapid, anti-jolting handling, and thus adds significant handling speed without jeopardizing precision positioning.

These and other advantages which are offered by the system of the present invention will become more fully apparent as the description which now follows is read in conjunction with the accompanying drawings.

DETAILED DESCRIPTION OF, AND BEST MODE FOR CARRYING OUT, THE INVENTION

Figures 1, 2:
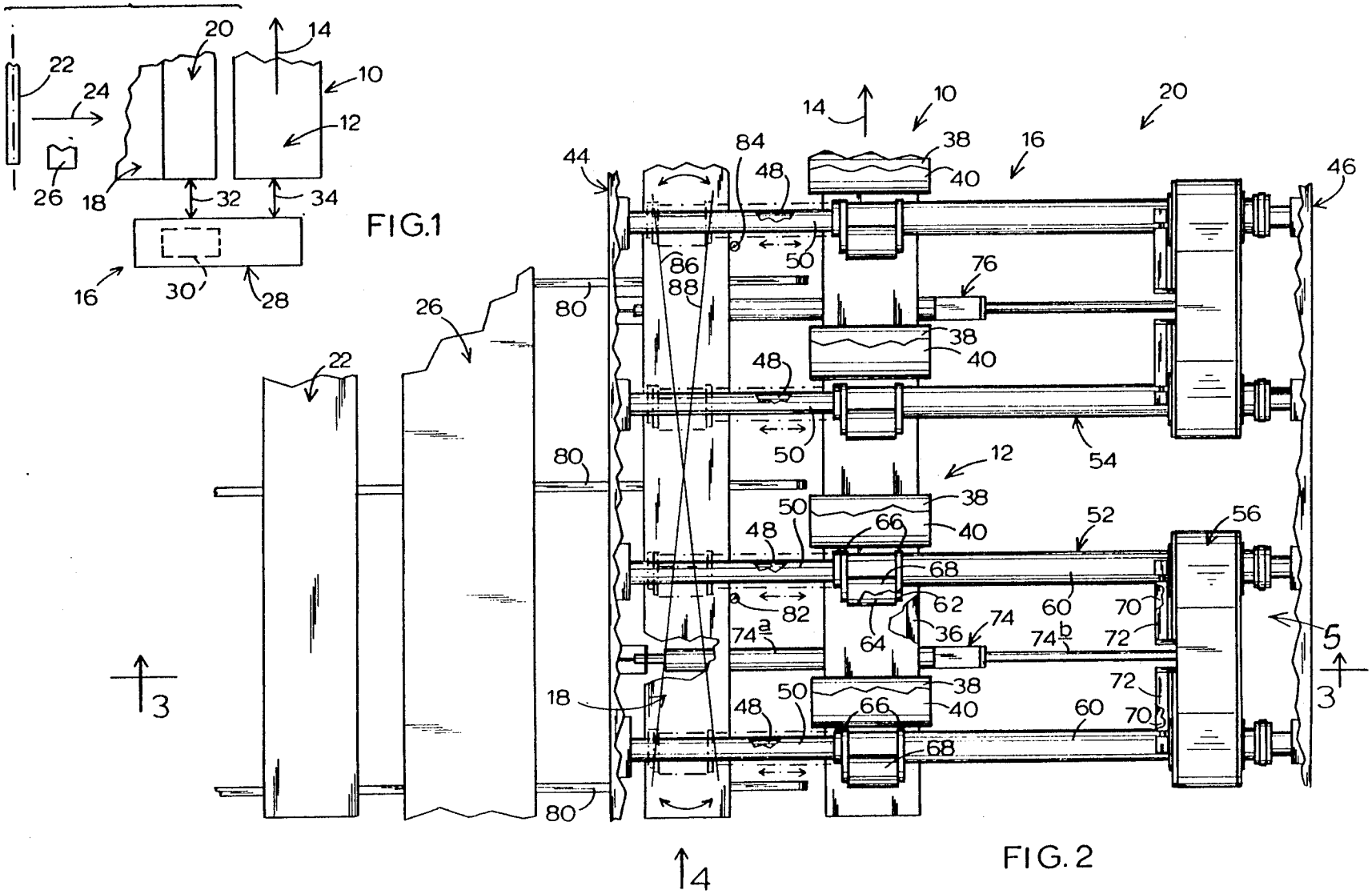
FIG. 1 is a simplified and fragmentary block/-schematic plan view illustrating a lumber workpiece edger installation including an edger charger system constructed in accordance with the present invention.
FIG. 2 is an enlarged and fragmentary plan view illustrating details of what is shown schematically in FIG. 1.

Turning now the drawings, and referring first of all to FIG. 1, this figure is employed herein to introduce the general overall organization of the present invention in an operative setting associated with a lumber workpiece edger. Thus, in this figure, a conventional edger is shown generally at 10 including an intake station 12 from which successive workpieces fed into this station are taken by power-driven clamp-roll mechanism (still to be illustrated and described) for endo-feed in the direction of arrow 14 along the transport axis of the edger. 14 also represents the transport axis of the edger.

Indicated generally at 16 is an edger charger system constructed in accordance with the present invention. System 16 includes a precharge station 18 which is laterally offset (to the left in FIG. 1) from intake station 12, and what is referred to herein as reversibly laterally shiftable positive-action pinch-roll mechanism 20 which operates as will be explained for the rapid and gentle transfer of successive workpieces from precharge station 18 toward and into intake station 12 for hand-off to the edger.

Lumber workpieces, like the idealized board shown generally at 22, are transported conventionally and laterally, in the direction of arrow 24, past a conventional electro-optical scanning system 26 towards and into precharge station 18. On the basis of data acquired from the scanning system, and typically under computer control, a trimming decision is made with respect to creating a proper pre-cued (angularly and laterally) position which the board should occupy in precharge station 18 prior to being transferred to the edger. The same decision may also be used conventionally to adjust the positions of edger blades in the edger. As was mentioned earlier, such a trimming decision is based upon factors promoting maximum yield of usable end product. Located in and adjacent precharge station 18 is conventional pre-positioning structure which creates an appropriate cued orientation for a workpiece, and such structure is illustrated in more detail in other drawing figures still to be discussed.

Mentioned at this point, but not specifically shown in the charger system as illustrated in FIG. 1, are hydraulic linear positioners that are drivingly connected to the previously mentioned pinch-roll mechanism for producing rapid yet gentle motion of the same for transferring workpieces to the edger.

Further forming part of charger system 16 is control apparatus shown generally at 28, including electronic computer structure indicated in dashed lines at 30. Operative interconnections which will be more fully discussed later exist between the control apparatus and various motion components in the edger and in the charger, and these operative interconnections are represented in FIG. 1 at 32, 34.

Turning attention now to FIGS. 2–5, inclusive, here there are shown certain mechanical details of the edger and charger system schematically presented in FIG. 2. By and large, the mechanical structures employed are conventional, can take a variety of different forms, and are generally well-known to those skilled in the wood products field. Accordingly, illustration and description given herein with respect to these figures are intended to show generally how edger charger components may be built and integrated with a companion edger, without focusing on precise and specific details of construction. Indeed, where a charger system constructed in accordance with the present invention is intended to be retro-fitted, as may often be the case, in a mill having existing edger apparatus, it is highly likely that the specific system configuration, vis-a-vis its mechanical and motion components, will have to be tailored for an appropriate fit.

Figure 3:
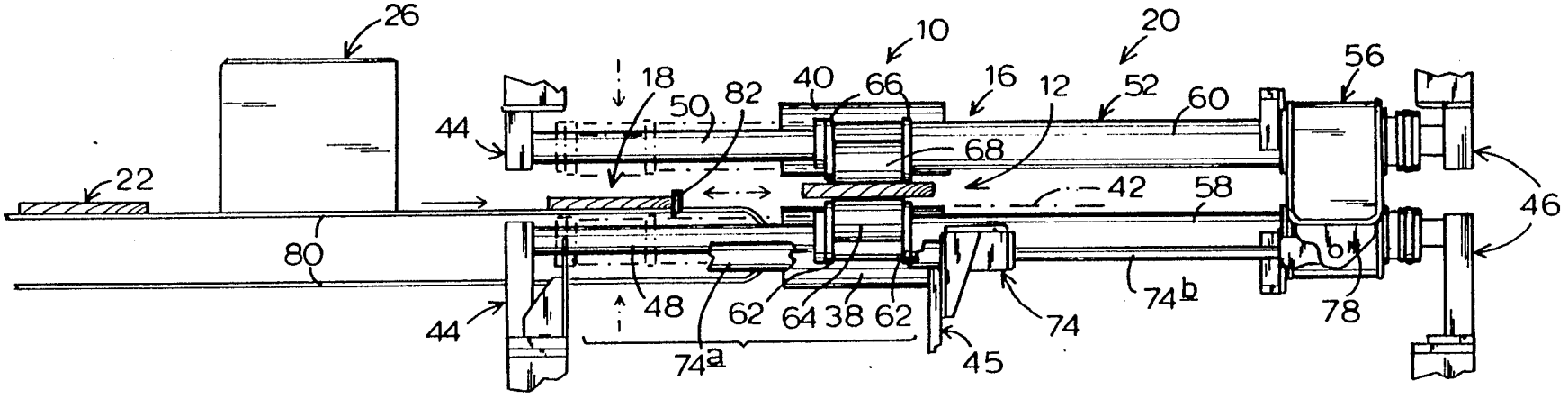
FIG. 3 is a view taken generally along line 3—3 in FIG. 2.
Figure 5:
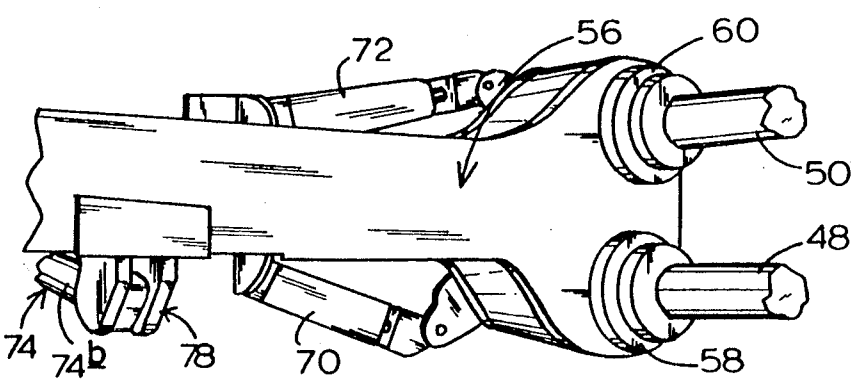
FIG. 5 is an enlarged fragmentary perspective elevation taken generally from the point of view of arrow 5 in FIG. 2, illustrating carriage structure, pinch-roll actuator mechanism, and a linear-positioner drive connection with the carriage structure, all forming part of the charger system of the invention.

Edger 10 as disclosed herein is what might be thought of as a single-line edger including an elongate frame, a portion of which is shown at 36 in FIG. 2. Distributed along the length of the frame is what is referred to herein as endo-feed clamp-roll mechanism including plural pairs of vertically spaced surface-textured clamp rolls, including lower clamp rolls, such as rolls 38, and upper clamp rolls, such as rolls 40. The lower clamp rolls, which are power-driven to transport a workpiece endo in the direction of previously mentioned arrow 14, define a generally horizontal support datum plane for a workpiece, which plane is shown by dash-dot line 42 in FIG. 3. The upper clamp rolls are mounted in a conventional manner on frame 36 for controlled reversible pressurized lowering onto the top surface of a workpiece to clamp the same between rolls 38, 40. In FIGS. 2 and 3, particularly illustrated in FIG. 3, these clamp rolls are shown in an open, non-clamping condition.

Previously mentioned intake station 12 is shown in FIGS. 2 and 3.

Edger charger system 16 herein includes a frame which laterally straddles the long axis of edger 10, including left, central and right frame structures (seen in FIGS. 2 and 3) 44, 45, 46, respectively. Extending between structures 44, 46 in the regions adjacent the pairs of opposing clamp rolls in the edger, are pairs of vertically displaced transversely extending cylindrical shuttle guides, including lower guides 48 and upper guides 50.

In the charger system now being described, pairs of vertically adjacent guides 48, 50, in groups of four guides in total, act as transverse shuttle ways for plural pinch-roll mechanisms, two of which are shown at 52, 54 in FIGS. 2 and 3. The number of guides and pinch-roll mechanisms employed depends upon the maximum length of workpieces which are expected to be handled. In edger charger 16 the maximum expected workpiece length is about 10-feet, and the number of pinch-roll mechanisms preferably used for this is two.

Dimensioning is, of course, a matter of choice. However, in the construction which is now being discussed, the adjacent pairs of vertically displaced guides are spaced apart, center-line-to-center-line, by about 2-ft. 2-inches, and the vertical center line displacement between each pair of guides 48, 50 is about 9-inches.

The pinch-roll mechanisms are substantially identical in construction, and so, a description of mechanism 52 is typical. Included in mechanism 52 are a carriage 56 which, as can be seen, embraces four of the guides 48, 50, and journalled on this carriage are four rotary cylindrical sleeves, including lower sleeves 58 and upper sleeves 60 which "jacket" lower guides 48 and upper guides 50, respectively. Lower sleeves 58 (see particularly FIG. 3) through bracket structures, like bracket structure 62, carry idler pinch-rolls such as pinch-roll 64. Upper sleeves 60, through bracket structures, like those shown at 66, carry idler pinch-rolls, such as pinch-rolls 68. Each lower pinch-roll 64 vertically opposes an upper pinch-roll 68.

Rocking movement of the respective opposing pinch-rolls toward and away one another during operation of the charger system is caused by the actuation of pneumatic rams which act between carriage 56 and the rotary sleeves. For example, two lower rams 70 act between carriage 56 and lower sleeves 58, and two upper rams 72 act between carriage 56 and upper sleeves 60.

Provided for each pinch-roll mechanism for the purpose of shuttling the same back and forth in the charger is a fluid-operated (hydraulic) linear positioner, such as positioners 74, 76 provided for pinch-roll mechanisms 52, 54, respectively. Considering positioner 74, the cylinder 74*a* in the positioner is anchored to frame structures 44, 45, and the rod 74*b* is pinned to the underside of carriage 56 through a bracket structure 78.

Figure 4:
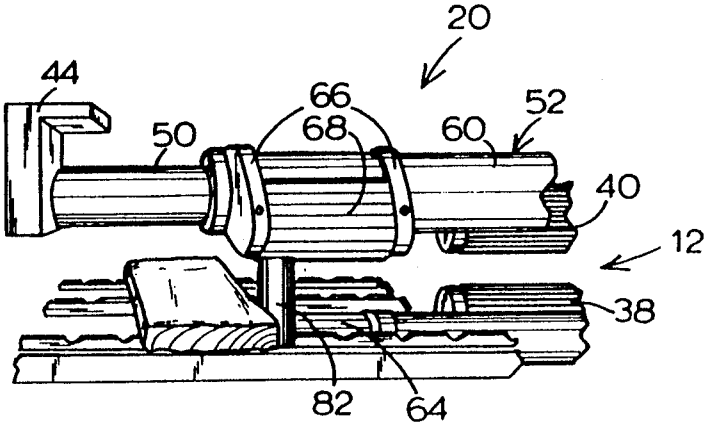
FIG. 4 is an enlarged fragmentary perspective elevation taken generally from the point of view indicated by arrow 4 in FIG. 2, illustrating a stage in the operation of the charger system of the invention.

In response to on-board programming associated with computer structure 30, the positioners provided for the pinch-roll mechanisms are operated in coordinated simultaneity to shift the pinch-roll mechanisms rapidly back and forth along the guide structure. In solid outline in FIGS. 2 and 3, the positioners are shown substantially fully extended with the pinch-roll mechanisms shifted to a condition where the pinch-rolls, shown gripping a board in these figures, are substantially axially in line with transport axis 14 within intake station 12. In dash-dot lines in FIGS. 2 and 3, the positioners have been contracted to shift the pinch-roll mechanisms to the left in the figure into positions where the pinch-rolls (shown open) are disposed within precharge station 18. In FIG. 4, a condition is illustrated where the pinch-roll mechanisms are in the process of being return-shifted from station 12 toward station 18.

The cooperative combination of the linear positioners and the computer structure enables operation of the former in such a fashion that the pinch-roll mechanisms can be, and are, rapidly accelerated at the beginning of travel to a suitable high speed, and then rapidly decelerated toward the end of travel. In charger system 16 the lateral travel distance, center-to-center, between stations 12, 18 is about 20-inches, and the positioners are operated in such a fashion that the shuttle transport time is about 0.46-seconds.

Workpieces which are to be edged, such as previously mentioned idealized board 22, are, in the manner mentioned earlier, transported laterally into precharge station 18 on suitable conveyor apparatus, such as the endless chains shown at 80 in FIGS. 2 and 3. On its way toward the precharge station, each workpiece passes previously mentioned scanning system 26 which, in cooperation either with computer structure 30, or with some other available computer structure, results in the creation of trimming decision data that determines how the workpiece should be pre-positioned in station 18. In the apparatus now being described, the pre-positioning structure, which can be conventional in construction, takes the form of a pair of raisable/lowerable and laterally shiftable positioning pins 82, 84 disposed as indicated (see FIG. 2 particularly). These pins can be shifted back and forth (to the right and to the left in FIGS. 2 and 3) in accordance with trimming-decision data in order to set a position for the leading edge of each workpiece to the same being transported in the edger. Positioning of these pins not only can determine a starting lateral offset determined for a workpiece, but also angular orientation. Two lines 86, 88, in FIG. 2 illustrate two of an infinite variety of angular preadjustments. A workpiece so arrested and adjusted in precharge station 18 is said to be in a cued and ready to feed condition.

Preferably, lateral shifting of the pins to determine the proper pre-feed leading edge location for a workpiece is done under the control of the computer structure in such a fashion that, in proper time relationship to movement of a workpiece toward the precharge station, the pins advance from a "home" condition toward final positions at a speed which is slower than that of the advancing board. An important consequence of this is that the pins tend gently to "gather" the board—minimizing board impact, and potential board bounce, with undesired but required ultimate, time-consuming board settling.

The various moving components in edger 10 and system 16 which are of interest herein, vis-vis a charging operation, are position-monitored utilizing conventional sensing devices so that sequence in timing control for interactive operation can take place. This is also true, of course, of the conditions of pins 82, 84.

Figure 6:
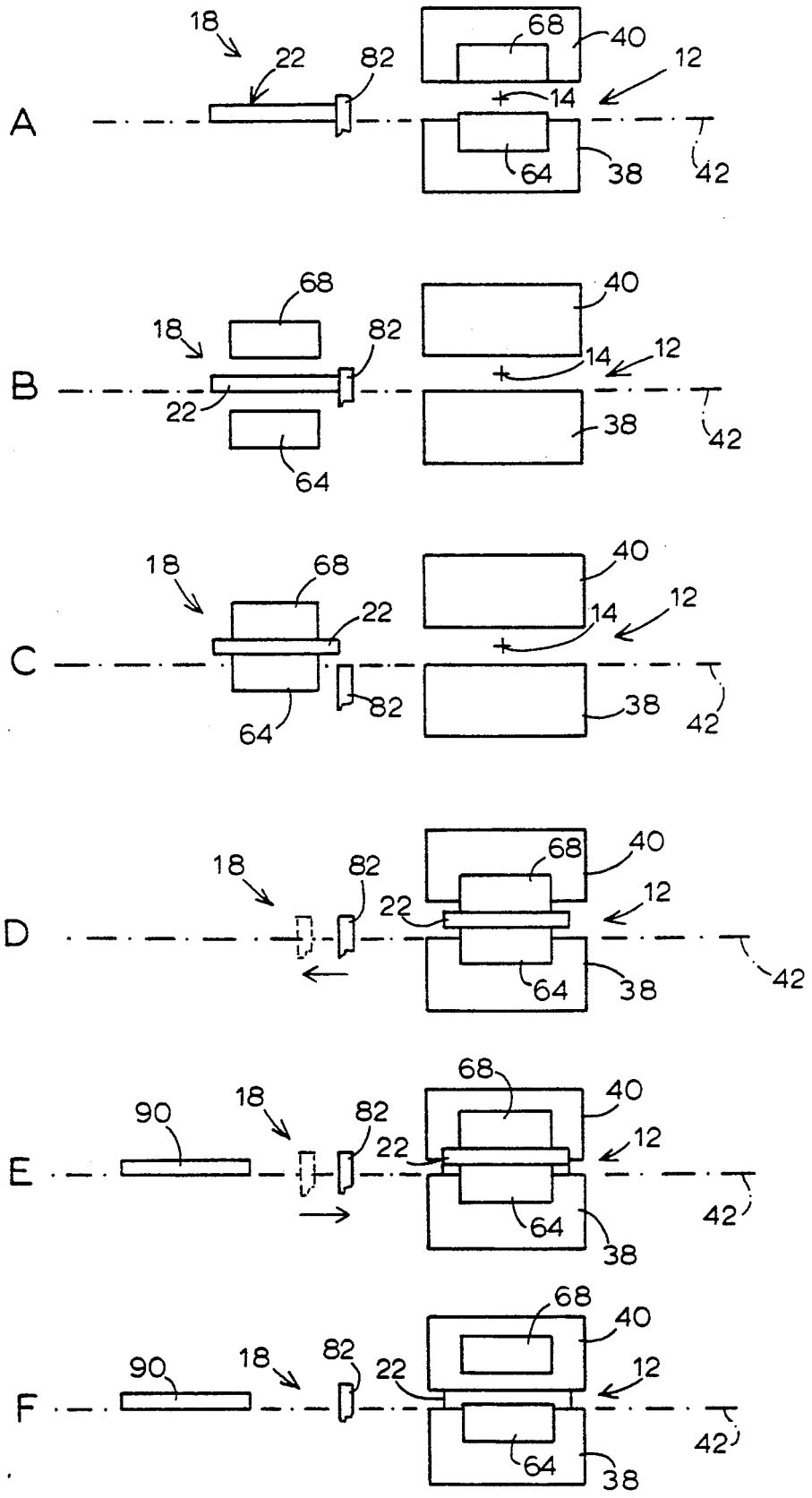
FIG. 6 illustrates very schematically, in six vertically displaced views, different stages of a single workpiece handling cycle performed by the system of the invention.

FIG. 6 in the drawings, in its six views A–F, schematically illustrates a typical single charging cycle for a workpiece, such as board 22.

In view A, clamp-rolls 38, 40 in the edger are open, and pinch-rolls 64, 68 are open with the latter located within intake station 12. The transport axis for the edger is shown at 14, and the support datum plane provided by rolls 38 is shown at 42. No board is illustrated in the edger.

Still continuing with view A, board 22 has been transported into precharge station 18 and is cued against pins 82, 84 (only pin 82 being illustrated in this view).

In view B, pinch-rolls 64, 68, under the influence of the linear positioners, have been shifted rapidly from intake station 12 toward and into precharge station 18, and are shown in open conditions on opposite (top and bottom) faces of board 22. The positioning pins are still raised to hold the board in a properly cued condition, and the clamp-rolls in the edger remain open.

View C differs from view B in that the cuing positioning pins have been dropped to provide transfer clearance for board 22, and pinch-rolls 64, 68 have gripped opposite sides of the board. Gripping of the board by the pinch-rolls occurs just immediately prior to dropping of the positioning pins.

In view D, under the influence of the linear positioners, the pinch-rolls have been shifted rapidly from precharge station 18 toward and into intake station 12, with pinch-rolls 64, 68 continuing to grip board 22. The cuing positioning pins have been reelevated. The pinch-rolls hold board 22 at a slight elevation above plane 42.

While this activity takes place, the positioning pins return to what were referred to earlier as their "home" positions, and this is indicated in FIG. D by the stubby arrow which points to the left to indicate return motiion of pin 82 toward the position illustrated for it in dashed lines.

In view E, while the pinch-rolls continue to grip board 22, upper clamp-rolls 40 close upon the top surface of the board, drive it downwardly against lower clamp-rolls 38, whereupon the edge has, in effect, "taken" the board for endo-feeding through the edger. It is particularly important to note here that the hand-off between the charger and the edger occurs under a circumstance with the board, under all circumstances, being clamped in a proper feeding orientation. In other words, the pinch-roll mechanism does not release the board until after the clamp-roll mechanism has gripped it.

Further shown in view E is the approach of another board 90 into precharge station 18. As board 90 approaches station 18, the positioner pins travel under computer influence from their "home" positions toward properly determined final positions, at a speed which is less than the oncoming travel speed of this board. Thus, the board catches up with the pins (while the latter are still moving) in a gentle non-bouncing siutation. Pin motion is indicated by the stubby arrow in FIG. E illustrating movement of pin 82 from its home (dashed-line) position toward a final position shown in solid outline.

In the final view F, pinch-rolls 64, 68 have opened up to free themselves of contact with board 12 which is now on its way through the edger, with these pinch-rolls still within intake station 12. The next successive board 90 has been pre-positioned for handling in pre-charge station 18.

The cycle then repeats.

Overall time for a single handling cycle is charger system 16, and this will by typical, is about 1.32-seconds. Such translates into a nominal throughput rate of about 45-workpieces-per-minute.

From the description which has just been given, those skilled in the art should appreciate the significant advantages offered by the charger system of the present invention. Extremely rapid handling of workpieces occurs, and this takes place without violence or jolting because of the fact that the use of linear positioners under computer control enables carefully controlled rapid acceleration and deceleration. Precision is maintained, not only because of the absence of jolting, but also because of the fact that throughout the entire handling cycle, and once a workpiece has been collected in the precharge station, it is facially clamped in a proper feed of orientation through final hand-off to the clamp-rolls in an edger.

While a preferred embodiment of the invention has been described herein, it is appreciated that variations and modifications can be made. For example, dimensions can be changed, different lengths of workpieces can be handled utilizing an appropriate number of shuttle pinch-roll mechanisms, linear positioners can be employed selectively to feed workpieces from a single precharge station into a plurality of laterally offset edgers of edger lines if desired, and so on. All of these variations and modifications which will become apparent to those skilled in the art may be made without departing from the spirit of the invention.

It is claimed and desired to secure by Letters Patent:

1. A facial-grip, clamp-overlap, positive-action, anti-jolt charger system for a lumber workpiece edger of the type having an intake station and a power-driven longitudinal-feed clamp-roll mechanism operable in recurrent cycles to receive, clamp onto and longitudinally-feed, for, edging successive workpieces arriving in the intake station, said charger system in operative condition relative to such an edger comprising a pre-charge station laterally offset from the intake station for receiving and holding angularly and laterally position-cued workpieces in succession one at a time, reversibly laterally shiftable, positive-action pinch-roll mechanism disposed adjacent said pre-charge station, adapted to grip opposite faces of successive workpieces held in the pre-charge station and to accommodate lateral transfer of such workpieces, while the same are so gripped, toward and into the edger's intake station for time-overlapping clamp/-grip hand-off of the workpieces to the edger's clamp-roll mechanism for longitudinal feed through the edger, controlled acceleratable/deceleratable linear-positioner means drivingly connected to said pinch-roll mechanism for producing rapid, recurrent, anti-jolt, reversible shifting of the same between the pre-charge and intake stations, and control apparatus operatively interconnecting components in the edger and components in the charger, whereby successive workpieces held in the pre-charge station are positively gripped by the pinch-roll mechanism, transferred in an anti-jolt fashion and without angulation toward and into the intake station, and handed-off, while still gripped against angulation and lateral maladjustment by the pinch-roll mechanism, to the longitudinal-feed clamp-roll mechanism for transport through the edger.

2. The charger of claim 1, wherein said linear positioner is hydraulically powered, and said control apparatus includes electronic computer structure operable to control the flow of hydraulic fluid relative to said positioner.

* * * * *